US012649974B2

(12) United States Patent
Marchal

(10) Patent No.: US 12,649,974 B2
(45) Date of Patent: Jun. 9, 2026

(54) ELECTROCHEMICAL CELL PLANT

(71) Applicant: ITM Power (Trading) Limited, Sheffield (GB)

(72) Inventor: Frederic Marchal, Sheffield (GB)

(73) Assignee: ITM Power (Trading) Limited, Sheffield (GB)

( * ) Notice: Subject to any disclaimer, the term of this patent is extended or adjusted under 35 U.S.C. 154(b) by 886 days.

(21) Appl. No.: 17/793,193

(22) PCT Filed: Jan. 18, 2021

(86) PCT No.: PCT/GB2021/050111
§ 371 (c)(1),
(2) Date: Jul. 15, 2022

(87) PCT Pub. No.: WO2021/144594
PCT Pub. Date: Jul. 22, 2021

(65) Prior Publication Data

US 2023/0057244 A1 Feb. 23, 2023

(30) Foreign Application Priority Data

Jan. 17, 2020 (GB) ..... 2000746

(51) Int. Cl.

| | |
|---|---|
| ***C25B 1/04*** | (2021.01) |
| ***C25B 9/67*** | (2021.01) |
| ***C25B 9/70*** | (2021.01) |
| ***C25B 15/08*** | (2006.01) |

(52) U.S. Cl.
CPC ..... *C25B 1/04* (2013.01); *C25B 9/67* (2021.01); *C25B 9/70* (2021.01); *C25B 15/083* (2021.01)

(58) Field of Classification Search
CPC .. C25B 1/04; C25B 1/044; B01D 19/00–0495
See application file for complete search history.

(56) References Cited

U.S. PATENT DOCUMENTS 3,575,387 A * 4/1971 Bradley, Jr. ..... F04D 29/462 261/111
5,922,178 A 7/1999 Isenberg
5,997,702 A 12/1999 Koganezawa et al.
(Continued)

FOREIGN PATENT DOCUMENTS

CN 201598337 U 10/2010
CN 101654786 B 1/2011
(Continued)

OTHER PUBLICATIONS

Li et al., Original & Machine Translation, CN 105862066 A (Year: 2016).*
(Continued)

*Primary Examiner* — Hosung Chung
(74) *Attorney, Agent, or Firm* — Harness, Dickey & Pierce, P.L.C.

(57) ABSTRACT

A system comprising an electrolyser stack connected to a water/gas separation vessel, via an inlet and an outlet pipes, wherein the separation vessel is adapted to passively separate the water and gas; the separation vessel contains a heat exchanger; and the separation vessel is constructed from a polymer material.

17 Claims, 11 Drawing Sheets

(56) References Cited

U.S. PATENT DOCUMENTS

| | | | | |
|---|---|---|---|---|
| 2003/0201187 | A1* | 10/2003 | Speranza | C25B 1/04 205/252 |
| 2015/0034479 | A1* | 2/2015 | Pan | C25B 11/00 204/278 |
| 2015/0292092 | A1* | 10/2015 | Yao | C25B 1/245 204/246 |
| 2016/0178109 | A1* | 6/2016 | Nippes | E03F 3/06 405/184.1 |
| 2019/0360110 | A1* | 11/2019 | Mohri | F25B 47/006 |

FOREIGN PATENT DOCUMENTS

| | | | |
|---|---|---|---|
| CN | 101654787 | B | 1/2011 |
| FR | 3065467 | A1 | 10/2018 |
| JP | S58151406 | A | 9/1983 |
| JP | H08215533 | A | 8/1996 |
| JP | H0976356 | A | 3/1997 |
| JP | 2002-028422 | A | 1/2002 |
| JP | 2011-168862 | A | 9/2011 |
| JP | 2011-256413 | A | 12/2011 |
| JP | 2015-193054 | A | 11/2015 |
| SU | 444551 | A1 | 9/1974 |

OTHER PUBLICATIONS

Zhang et al., Original & Machine Translation, CN 105696012 A (Year: 2016).*

Tanimoto, Original & Machine Translation, JP 2011-256413 A (Year: 2011).*

Zheng et al., Original & Machine Translation, CN 206389941 U (Year: 2017).*

Flick, Plastics Additives An Industrial Guide (Year: 2001).*

Hoeller, Original & Machine Translation, WO 2019/238218 A1 (Year: 2019).*

International Search Report for International Application No. PCT/GB2021/050111 dated Apr. 23, 2021.

Examination Report for Japanese Application No. 2022/543090 dated Jan. 14, 2025 and English translation.

Search Report for European Application No. 2000746.4 dated Jul. 14, 2020.

* cited by examiner

ELECTROCHEMICAL CELL PLANT

CROSS-REFERENCE TO RELATED APPLICATIONS

This application is a national phase under 35 U.S.C. § 371 of PCT International Application No. PCT/GB2021/050111 which has an International filing date of Jan. 18, 2021, which claims priority to United Kingdom Application No. 2000746.4, filed Jan. 17, 2020, the entire contents of each of which are hereby incorporated by reference.

FIELD OF THE INVENTION

The present invention relates to electrolyser systems and separation and cooling of the water and gas.

BACKGROUND OF THE INVENTION

Conventionally water electrolysis systems vent oxygen and reject heat to atmosphere, with the hydrogen being the valuable component. This green hydrogen, produced from renewable sources via electrolysis, is used in an ever-expanding set of applications. Examples of such applications are: transport fuel, long-term energy storage and renewable chemistry.

Traditionally, electrolyser stacks are connected to a heat exchanger and associated pumps via multiple pipes. The heat exchanger/pumps are then connected to a gas separation tower. Water and oxygen produced by the electrolyser stacks are fed via pipes to separate pumps/heat exchanger to allow for cooling, and the oxygen and hydrogen are then fed to the separate gas separation tower. The water, once cooled, is fed back via pipes to the electrolyser stacks. Traditionally, these components are positioned separately from one another, and are connected by pipes that cover long distances. The reason for this is due to the preference in the industry to use a large pump (thought to be cheaper/easier). In this system, the water is required to be pumped back and forth over long distances, and this can lead to pressure losses, and has the material cost of requiring more pipe work. There is also a large balance of plant in these systems.

The separate positioning of components, and the long distances between them, also means that no testing facility is possible at a site where all of the pumps, heat exchanger, and electrolyser stacks are located. This is not optimal because the final system cannot be tested before it is constructed.

The electrolyser systems of the prior art therefore comprise elements that are not able to be manufactured in an efficient factory setting. Instead, they require multiple links to be assembled in the field, without being tested beforehand.

Oxygen and heat are also becoming valuable by-products of electrolysis (rather than just hydrogen being the valuable commodity). In order to extract these by-products, parts are added to the electrolyser systems rather than efficiently integrated. These parts are usually metal-based. The conventional manufacturing techniques usually relied upon are metal fusion welding, flange joint assemblies with spanners, and field pipeline assembly with little consideration for the number of parts deployed; this causes considerable manufacturing difficulties in a modern plant deployment scheme.

Currently, in designing electrolysis plants, the process engineering discipline lays out segregated and generic process apparatus comprising electrolyser stacks, pipes, a heat exchanger (removing heat from process water), more pipes, 'knock out' separation tower (separating water and oxygen gas), multiple flange joints (with nuts bolts and tie rods), pump skids, glycol tank with pipeline and associated air-flow cooling (adjoined to primary cooling). Also required are huge fabrications to package them together and link them to water pipework of large diameter bore with trace heating, thermal compensation and structural supports (weight hangers, props and so on). These are also complemented with new schemes of oxygen recovery, compression of hydrogen and/or oxygen, gas storages and heat recovery. These components are laid out sometimes over long distances and contribute to a large footprint, which itself warrants larger bore pipelines, assembly complexity and high cost.

The present invention provides a system including a compact oxygen separation vessel that is strong and cost effective to manufacture.

SUMMARY OF THE INVENTION

The present invention is an effective and environmentally-sustainable complete water electrolysis system (cooling water and separating gasses from the water), which can be fully built, in repeatable units, in a factory setting. It can also be tested in the factory before deployment onto site, which has many benefits, such as maintaining a high standard of cleanliness. The entire system is positioned on a single site, with short distances for the water and gasses to travel. This has economic and environmental benefits.

Therefore, according to a first aspect of the invention, a system comprises an electrolyser stack connected to a water/gas separation vessel, via an inlet and an outlet pipes, wherein:

- the separation vessel is adapted to passively separate the water and gas;
- the separation vessel contains a heat exchanger; and
- the separation vessel is constructed from a polymer material.

According to a second aspect of the invention, a method for electrolysing water uses the system as defined above, wherein the gas/water separation vessel contains water, and wherein the electrolyser electrolyses the water to produce hydrogen and oxygen, which then flow through a pipe to the separation vessel, where one of both of the hydrogen and oxygen are passively separated from the water and extracting from the system.

According to a third aspect of the invention, there is provided an oxygen separation vessel for passively separating water from a mixture of oxygen and water, the vessel comprising: a plurality of inlet nozzles for receiving the mixture of oxygen and water; a heat exchanger positioned within the vessel for cooling the mixture of oxygen and water; at least one oxygen outlet for outputting oxygen separated from the mixture of oxygen and water; and at least one water outlet nozzle for outputting water separated from the mixture of oxygen and water.

The vessel of the third aspect can be used in combination with the system and methods of the first and second aspects respectively. The vessel of the third aspect is preferably for use in combination with an electrolyser stack, e.g. an electrolyser stack for producing hydrogen.

The vessel of the third aspect provides an oxygen separation vessel that is strong, compact, and cost effective to manufacture.

Having a plurality of inlet nozzles leads to the creation of multiple columns of the mixture within the vessel in use, which greatly enhances the rate of oxygen/water separation for a given vessel height, thereby allowing the vessel to be much shorter than conventional oxygen separation vessels. For example, a vessel according to the present invention may be around 2.5 m in height, whereas conventional vessels are generally around three times this height.

There may be two inlet nozzles, three inlet nozzles, four inlet nozzles, five inlet nozzles or any other number of inlet nozzles greater than one. Preferably, there are three inlet nozzles, which allows three columns of the mixture to be created.

In addition, having an oxygen separation comprising a heat exchanger (i.e. the heat exchange is inside the oxygen separation vessel) is unconventional and reduces the power that is required to pump the water out of the vessel.

In conventional systems, the heat exchanger is positioned downstream of the oxygen separation vessel, with a pump positioned between the oxygen separation vessel and the heat exchanger. In this conventional arrangement, the pump is positioned before the heat exchanger in order to overcome pressure drop through the heat exchanger.

Positioning the heat exchanger inside the vessel means that the electrochemically generated oxygen pressure (i.e. generated during electrolysis) leads to an increased pressure within the vessel, which in turn applies a pressure to the free liquid surface of water inside the vessel. This pressure helps to overcome the pressure drop through the heat exchanger, which in turn means that the pump power can be reduced accordingly.

A reduction in pump power of 18% is possible with this arrangement, which leads to considerable electricity savings. As the power used by the pump during electrolysis is 'parasitic' power use, such a reduction effectively reduces the cost of hydrogen production. This is especially important in low power scenarios, such as when the electrolyser is powered by solar panels on an overcast day or powered by wind turbines on a calm day. In these low power scenarios, the power required by the pump can represent a significant proportion of the total power that is consumed.

Preferably the vessel (i.e. a main body of the vessel) is constructed from a plastic/polymer material. The vessel may be constructed of partially crosslinked linear low-density polyethylene 'LLDPE' (such as ICORENE® LLDPE). Alternatively, the vessel may be constructed of high-performance hexane high density polyethylene.

Preferably, the inlet nozzles are positioned at or close to the top of the oxygen separation vessel. Close to the top means that the nozzles are positioned in a region defined by the top 25% of the vessel in use, more preferably within the top 10% of the vessel.

Positioning the inlet nozzles close to the top of the vessel means that the multiple columns of the mixture created by the inlet vessels are larger/taller, thereby allowing for enhanced water/oxygen separation.

The vessel may further comprise at least one through-hole for receiving a transversal bracing element, preferably wherein the at least one through-hole has a substantially rectangular or substantially elliptical cross section.

The through-holes may also be referred to as through-apertures, through-channels or similar.

The through-holes allow the vessel to be provided with transversal elements that reinforce/strengthen the vessel. During use, high pressures are experienced within the vessel that may otherwise lead to buckling/breaking of the vessel. In addition, the through-holes themselves also improve the strength of the vessel by providing a bridge between the sidewalls, and they provide vacuum stability against a vacuum that may occur as a result of pump negative head of suction (i.e. the through-holes provide a strengthening effect even in the absence of bracing elements).

The use of through-holes with a rectangular or square cross section is especially preferred because it facilitates wall thickness homogeneity of the polymer/plastic liner during manufacture, thereby simplifying manufacture.

Preferably, the vessel further comprises a transversal bracing element received in the at least one through-hole. Each through-hole may have a transversal bracing element. The transversal bracing element is preferably made of steel. The transversal bracing element may be a tie rod or similar. The bracing elements may alternatively be referred to as reinforcing elements or similar.

Preferably, the vessel further comprises external sheet cladding covering at least part of the external surface of the vessel. Preferably, the cladding is made of is made of steel, such as pressure steel plate (e.g. EN10028 P460 pressure steel plate). The cladding may also be provided as glass fibre reinforcement. Also referred to as glass reinforced plastic (GRP), the glass fibre reinforcement may be used with linear low-density polyethylene (LLDPE), medium-density polyethylene (MDPE), polypropylene (PP) or high-density polyethylene (HDPE) liners.

The cladding reinforces the vessel and increases the pressures that it can withstand.

While the cladding and transversal bracing elements alone each provide a substantial reinforcing effect, the use of the cladding and transversal bracing elements in combination further enhances the reinforcing effect because it helps to spread the load exerted by the bracing elements on the side walls of the vessel, thereby increasing the load that the vessel can withstand before breaking or buckling.

The vessel may alternatively have at least one circumferential groove for receiving a circumferential bracing element. For example, such a circumferential bracing element may be a steel ring or similar that strengthens the vessel.

Preferably, the vessel further comprises two external end plates arranged at opposing ends of the vessel, wherein the external end plates are coupled by one of more longitudinal bracing elements.

Such end plates and longitudinal bracing elements provide further reinforcement to the vessel. Preferably, the end plate is made of steel, such as EN10028 P460 pressure steel plate or P350 steel or 300 series stainless steel of suitable thickness. The bracing elements are preferably also made of steel. The bracing elements may be tie rods or similar.

Optionally, the plurality of inlet nozzles and the at least one water outlet nozzle may be integral with the vessel and constructed from the same material as the vessel, preferably wherein the nozzles are connected to the pipes by polymer fusion, which is very cost effective.

Preferably, the inlet nozzles are arranged such that they are positioned at substantially the same height (i.e. when the gas separation is in the orientation in which it is used). Substantially means that they are at the same height within a deviation of 10% of the total height of the vessel.

Preferably, the vessel is rotation moulded in a single one-shot process.

Preferably, the vessel has a flat oval cross-section, with flat side walls being positioned vertically, in use.

Even more preferably, the inlet nozzles are positioned such that, in use, they direct fluid flow towards a (preferably flat) side wall of the vessel, such that a cyclone effect is created. This increases the efficiency of the water/oxygen separation process, thereby allowing the vessel to be even more compact.

In other words, the inlet nozzles may be positioned such that, in use, they direct fluid flow along the curvature of one side wall of the vessel and towards an opposing side wall, such that centrifugal force is harnessed to enhance the mixture of fluid and gas separation.

Preferably, the vessel is constructed of high-performance hexane high density polyethylene. It is clean, stiff and offers high environment stress crack resistance. Alternatively, the vessel may be constructed of other materials, such as partially crosslinked linear low-density polyethylene.

Optionally, the vessel may have a tapered collector located between the heat exchanger and the at least one water outlet nozzle. This increases the velocity of fluid flow through the water outlet nozzle.

Optionally, the heat exchanger may be a tube heat exchanger.

Preferably, the oxygen separation vessel further comprises a sleeve arranged around the tube heat exchanger, preferably wherein the sleeve is made of polymer material.

Preferably, the sleeve comprises an inlet, an outlet, and one or more baffle plates arranged to cause fluid to flow in a cross flow direction around the heat exchanger when in use. The baffles mean that disruption of the fluid at the boundary layer of the fluid and heat exchanger is maximised, thereby improving heat exchange. Cross flow means that the fluid flows in a direction having a non-zero component perpendicular to the tubular extent of the heat exchanger.

According to a fourth aspect of the invention, there is provided a system for generating hydrogen, the system comprising an electrolyser stack connected to the oxygen separation vessel of the third aspect.

Preferably, the system further comprises a pump connected to the at least one water outlet nozzle, wherein the pump is positioned downstream of the oxygen separation vessel. As discussed earlier, having the pump downstream of the gas separation vessel allows the pump power to be reduced, thereby saving electricity. The pump drives a flow of water out of the oxygen separation vessel.

LABELS IN THE FIGURES

Figure 1:
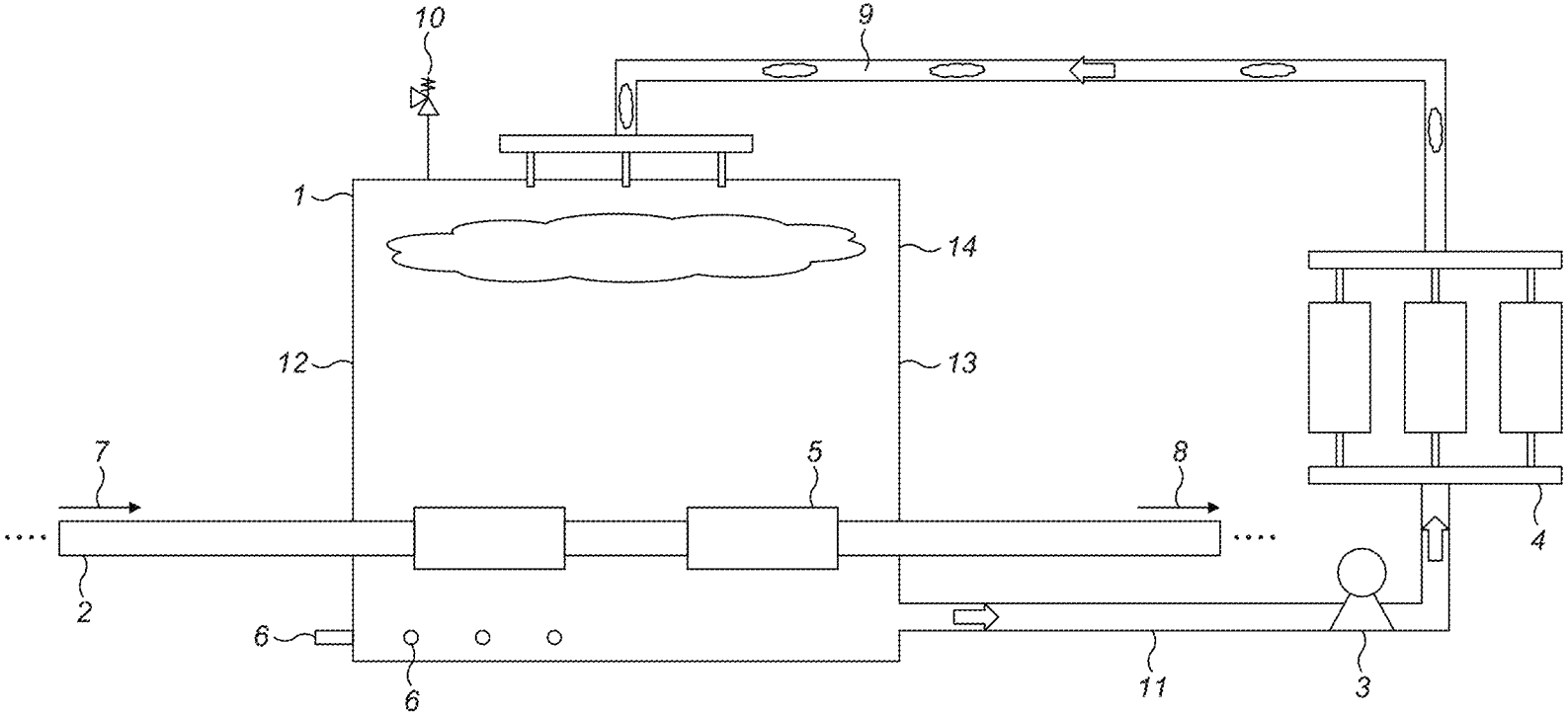
FIG. 1 shows a schematic of a preferred embodiment of the present invention.

1. Phase Separation Heat Exchange $O_2$ pressure One shot moulded vessel (1*a*, 1*b*, and 1*c* represent various configurations of the vessel).
2. Secondary Cooling circuit.
3. Pump.
4. Electrolysis Stack(s).
5. Heat Exchanger(s).
6. Moulded nozzles (6*a* are inlet nozzles/ports, 6*b* are outlet nozzles/ports).
7. Cold Feed.
8. Hot Outlet.
9. Water/Oxygen Mixture.
10. Pressure relief.
11. Primary Cooling circuit.
12. Up to 3 layer wall.
13. Composite materials pressure shell.
14. Anti microbial additive.
15. Region of turbulence created.
16. $H_2O$ Collector.
17. Vessel grooves.
18. Coolant inlet port.
19. Coolant outlet port.
20. Internal conduit.
21. Through-hole.
22. Oxygen outlet.
23. Exterior cladding.
24. Transverse tie rod.
25. End plate.
26. Longitudinal tie rod.

DESCRIPTION OF THE PREFERRED EMBODIMENTS

As used herein, electrolyser stacks and water/gas separation vessels (or towers) are terms that are used in the art. A stack comprises a plurality of electrolyser cells.

As used herein, heat exchanger is a term known in the art. In the context of electrolysers, they cool the water flowing through an electrolyser system.

The inventors have devised an electrolyser system comprising a multi-purpose vessel, which combines large clean water storage, oxygen and/or hydrogen separation from water, heat exchange, and optionally fabrication-less porting (i.e. avoiding the need to manufacture and add on additional ports) and increased cleanliness in one single module.

The advantage of the invention is that it allows for multiple, self-sufficient electrolysis modules i.e. repeatable and manageable units, as opposed to the prior art which requires electrolysers to be field assembled with pipes, separation towers and pumps, and then tested.

The oxygen separation vessel of the present invention is also smaller than conventional separation vessels, thereby making it easier to transport and install and allowing it to be installed in more confined spaces.

The core of the invention includes a two-fold modification over existing systems.

Firstly, locating a heat exchanger inside a gas separation tower reduces the balance of plant and increases efficiency. Secondly, the consolidated heat exchanger and gas separation unit can be coupled to the electrolyser via a short distance (since the components are compatible), which increases efficiency of the system. Previously, due to the large balance of plant, the electrolyser stacks had to be connected, via a much longer distance, to a large water/gas separation tower and separate heat-exchanger. This made on-site assembly and testing very difficult.

The gas separation vessel is constructed from a polymer material. Preferably, it is constructed from a plastics material.

The gas separation vessel may be constructed of partially crosslinked linear low-density polyethylene 'LLDPE' (such as ICORENE® LLDPE) or of high-performance hexane high density polyethylene. In addition, the gas separation vessel may have multi wall construction, having a pressure steel plate as an outer liner or cladding (such as EN10028

P460 or P350 steel or 300 series stainless steel of suitable thickness). Alternatively, the outer liner or cladding may be glass fibre reinforcement.

The separation vessel preferably comprises a plurality of nozzles for connecting to the inlet and outlet pipes, wherein the pipes are integral with the vessel and constructed from the same polymer material as the vessel. This has many manufacturing benefits.

In a preferred embodiment, the vessel comprises at least 4 nozzles, with at least 2 nozzles adapted to be in fluid communication with each pipe.

More preferably, the system comprises at least 6 nozzles, wherein at least 3 nozzles are adapted to be in fluid communication with each pipe.

Preferably, the vessel (preferably including the nozzles) is injection moulded or rotation moulded in a single one-shot process from a polymer material. More preferably, the pipes are also constructed from a polymer material. This is advantageous because then the various components may be connected by polymer fusion. This avoids the need for complicated metalwork and flanges as in the prior art.

The reduced number of parts in a system of the invention leads to design efficiency and ease of deployment; it may be achieved in the proposed invention by a rotational moulding technique, which generates up to 15 ports/nozzles directly on the vessel walls themselves. The said nozzles may then be connected directly to pipe work via automated polymer fusion welding, which requires no conventional fusion welder qualification, flanges, spanners, gaskets, nuts, bolts, and washers and also guarantees leak tightness.

The location of segregated ancillaries (tower and associated equipment) in the prior art, away from the hydrogen generation (stack), involves calculation of many parts (due to large bores, forces and weight involved) and leads to difficulties in managing flow and cleanliness. For example, heavy lifting is involved on site to assemble, with potentially pipe ends open to the elements on the site of construction.

A system of the invention is shown in FIG. 1. In a system of the invention, the water from the electrolyser stack(s) is fed into the consolidated gas separation and heat exchanger unit. In this consolidated unit, the heat exchanger is submerged in the water that flows into the gas separation tower, in use, and serves to cool the surrounding water. This cooled water is then fed back into the electrolyser.

In a preferred embodiment, the electrolyser stack is connected to the separation vessel over a short distance, so that it can be positioned in the same building, and preferably in close proximity to one another. The reduction in the distance between the electrolyser stack and the consolidated heat exchanger and gas separation unit avoids the various shortcomings of the prior art, such as the economic ramifications involved with transporting and pumping water over large distances.

The present invention consolidates the ancillary functions of electrolysis into a smallest common denominator (module) using the rules of design and assembly pertinent to lean assembly (low part count, rational interfaces) and establishing all manufacture and testing under a factory roof, in a controlled environment. Forming the product into such architecture benefits the organisation in several respects: first, it standardises the ancillary functions with a focus on compatibility; second, it reduces the part inventory and improves quality (e.g. one pump part number); thirdly, it reduces inventory (and all administrative tasks), cycle time of manufacture and also reduces site installation time to a minimum. The present invention may employ 'snap and go' pipework, by virtue of them being constructed from polymer materials. The system may then be connected via integral nozzles, and small bore pipes of less than 50 mm diameter may be used, reducing strain on workers and reducing the need for heavy duty equipment; this task is now best described as a trivial plumbing task. This is in sharp contrast with the use of 350 mm bore in the prior art; best described as heavy industry task. The present invention reduces footprint, pump losses and liability to dirt ingress, since it can be assembled in a factory setting.

The present invention is preferably manufactured in a one-shot injection moulding method. This has ease of manufacture benefits. It is preferably formed via rotational moulding. This allows for fast manufacturing.

In a preferred embodiment, the vessel is insulated to allow for preheating, convenient instrument fitting (water conductivity, level, and temperature measurements) as well as microbial growth prevention. In a preferred embodiment, the polymer vessel of the invention comprises an antibacterial or antifungal agent. Such agents are known in the art. The agent may be provided via the inclusion of an additive in the moulding process, and preferably in one debris-free recyclable thermoplastic moulding.

The vessel of the invention allows for full factory assembly, integration and testing and with a close integration to the stacks, this results in smaller bore, shorter pipework length being needed with less head loss whilst avoiding flange and porting fabrications, which results in assembly time savings, reduced likelihood of leak, reduced head pressure and need for flow management. This is because the elements of the system are no longer remote to the electrolyser stack and each other.

Figure 2:
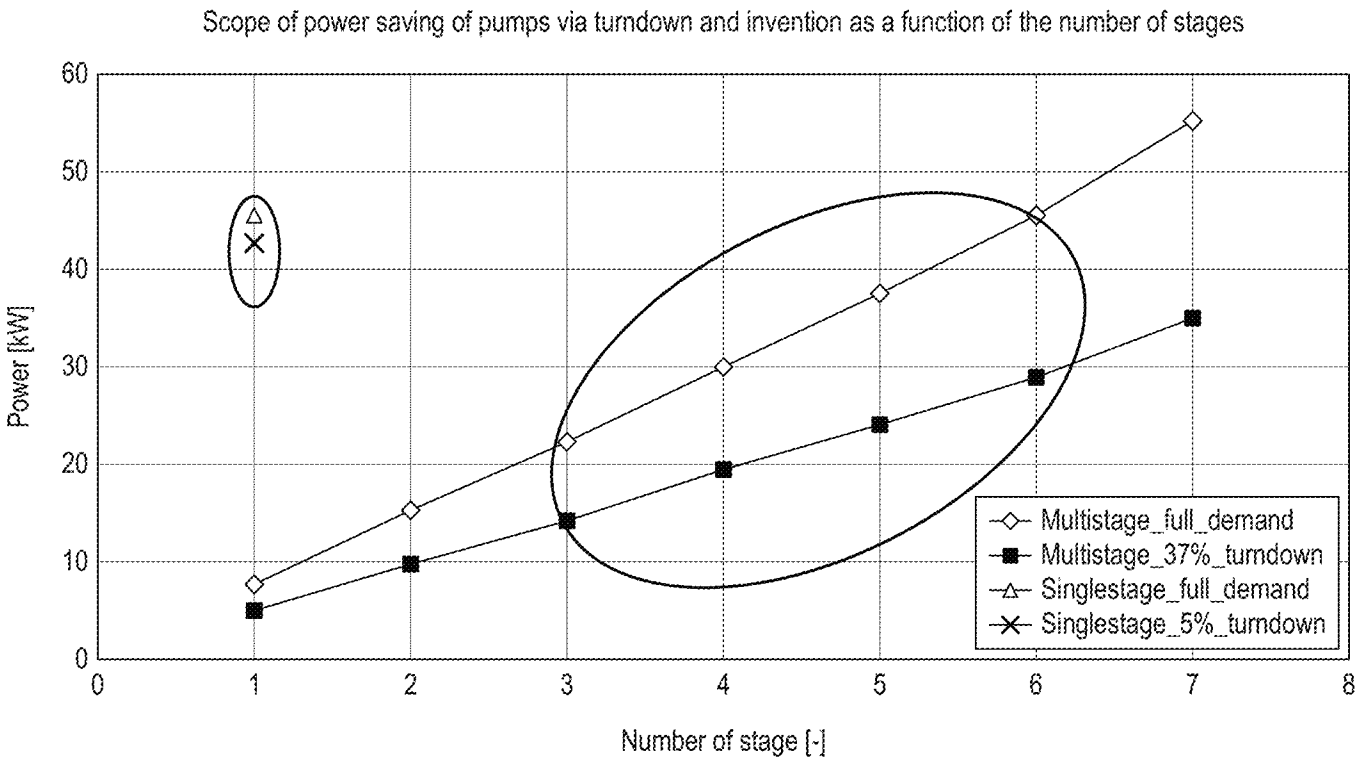
FIG. 2 is a graph to show that, in a 2 MW system, the pump savings are up to 1.5% of overall power use. When the plant is idle, with pumps running, this could be up to 70% of the current plant power saved.

The invention reduces part count, complexity and reduces pumping energy use. Significant pump power saving are contributed to by several factors. A typical embodiment of the invention will lower losses through the heat exchanger arrangement (see FIG. 2), shorter length of ductings (the beneficial aspect is friction losses are abated) and the ability to use a multistage pump, which permits energy saving adjustments to a greater degree than otherwise possible without the invention.

Figure 3:
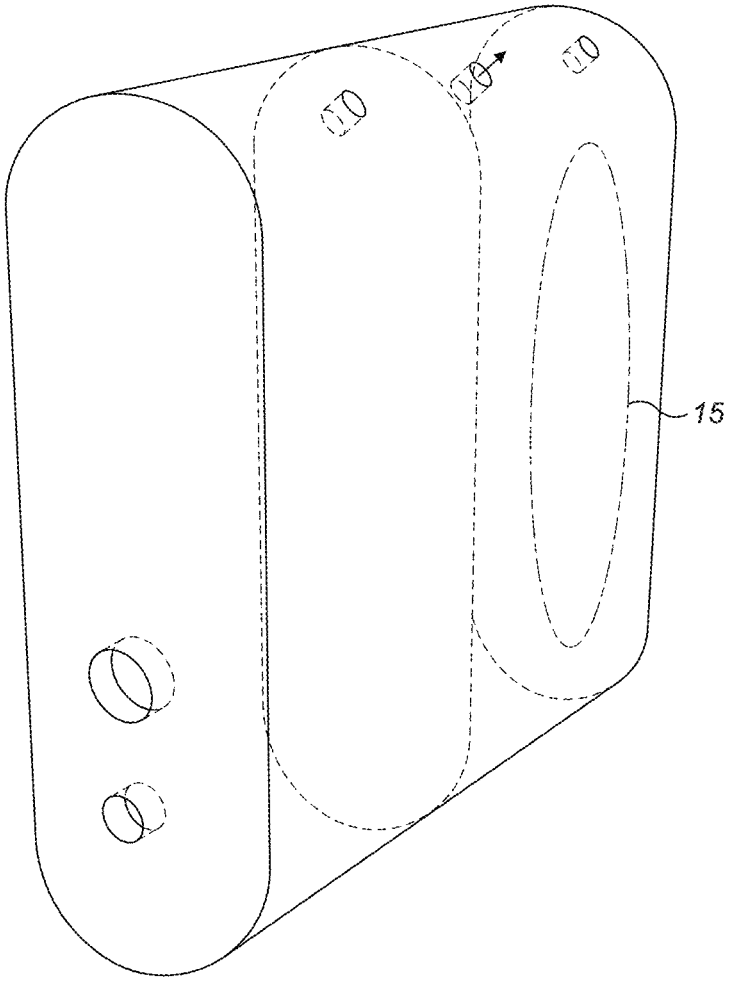
FIG. 3 is a schematic showing the fluid flow in a preferred embodiment of the invention (only the vessel is shown).

In a preferred embodiment, the vessel has a flat oval cross-section, with flat side walls being positioned vertically, in use. This embodiment is shown in FIG. 3. Preferably, the nozzles are positioned such that, in use, they direct fluid flow towards a (preferably flat) side wall of the vessel, such that a cyclone or centrifugal effect is created. The nozzles direct fluid flow along the curvature of one side wall of the vessel and towards an opposing side wall. This is also shown in FIG. 3. Preferably, the fluid flow is directed at about a 45 degree angle to the side wall, such that a region of turbulence, or a cyclone, is created. This enables for efficient water/gas separation. The angle of the nozzle (i.e. the inlet nozzle) may be between 30 and 60 degrees, more preferably between 35 and 55 degrees, even more preferably between 40 and 50 degrees, and most preferably about 45 degrees (i.e. between 44 and 46 degrees).

A wire brush may be located within at least one of the nozzles, such that the kinetic energy of the fluid stream is disrupted, in use.

In a preferred embodiment, a vortex breaker, vortex spoiler or demister pad is located within at least one of the pipes.

In a preferred embodiment, the proportions of the vessel are such that the ratio of the height, to a width of the vessel is less than 3:1 or 2:1, or preferably about 1:1. Without wishing to be bound by theory, this may be possible due to the nozzles directing fluid flow to a side wall such that a cyclone/centrifugal effect is created. This enables more effective water/gas separation and means that the separation vessel does not need to be as tall as those of the prior art.

The vessels of the prior art are mostly vertical 6:1 ratio of height to width for correct separation of gases and water. This is to stop water and gas mixture being re-admitted in the pump inlet. 6:1 ratio polymer-based and fusion welded vessels are ergonomically and manufacturing wise difficult to handle. They are fragile and likely to break and thus imply other costly necessary precautions. In a preferred embodiment of the invention, with its split ports (multiple nozzles) and a ratio of 1:1, ease of manufacture of the vessel itself is achieved by a rotational moulding process, and cleanliness on the process side is achieved as no burrs are created by joining flanges or manually drilling or de-burring plastics (these features are integral to moulding in a 'one shot' process).

The gas separation 'knock out' towers used in the systems of the prior art comprises a column of 1 m diameter by 6 m height (totaling 4.8 $m^3$), which is impractical to handle and manufacture in a fully equipped factory and difficult to export (via road or sea freight) or to assemble on site. This reduces the scope for effective deployment of a series of units. By contrast, the typical aspect ratio of a typical embodiment of the proposed invention is a cuboid of 2.6 m×2.6 m×1 m (totaling 6.8 $m^3$); a much more practical load to handle effectively.

In the prior art, many flanges are joined one by one, bolted on site to the said tower (as the finished assembly is too large to transport in one part), involving inefficient practices and tools and these are initially at least prone to more leaks that need to be fixed on site.

The heat exchanger for use in the invention is preferably a tube heat exchanger. This heat exchanger functions by having a supply of coolant, preferably cold water that flows through the interior of its tube-like structure, which then cools the metal exterior surface, and this cold metal exterior then cools the surrounding water within the gas separation tower, that has been fed in from the electrolyser stack. Process fluid is sucked through the shell side and into the pump inlet, whilst the tube side of the heat exchanger is connected to a refrigerant circuit. In the current state of the art, the heat exchanger is situated downstream of the pump. In the present invention, the heat exchanger is located upstream of the process pump. In the present invention's case the pressure drop through the heat exchanger is overcome by electrochemically generated oxygen pressure and specifically the absolute pressure applied to the free liquid surface in the suction vessel. Therefore the pump power can be reduced accordingly. A pressure drop reduction of 0.6 to 1 bar g would lead to a reduction of pump power of approximately 10 to 16%. (the overall pressure drop being approximately 6 bar in such system).

The present invention considerably reduces footprint, number of parts, and with a multiplicity of joint free nozzles, increases manufacture-ability. The present invention allows for a diversity of coolant type via specific choice of heat exchanger type (enabling a multiplicity of downstream integration possibilities), pump head loss virtual elimination from the primary cooling side avoiding pump 'parasitic losses' at reduced regime, but also oxygen pressure capability and built-in antimicrobial measures ensuring utmost cleanliness during idle time.

In a preferred embodiment, the heat exchanger, preferably a tube heat exchanger, is located at the highest flowing region of the vessel, thereby avoiding considerable resistance to flow on the vessel 'shell' side compared to a conventional plate heat exchanger. This reduces pump losses compared to a conventional plate heat exchanger (made out of a multiplicity of narrow and fluid impinging apertures). The head pressure saving was assessed using the pump affinity laws, governing centrifugal pumps based water circulation, and derived a minimum pump energy saving of 14%; this figure is achievable via the pressure head reduction through floating tube heat exchanger alone. Besides this, the tube heat exchanger is made out of one single fabricated part versus plate heat exchanger typically comprising a plurality of plates, seals, end plates, studs, washers and nuts.

The robustness and versatility of the type of heat exchanger selected can be stated in terms of chemical longevity, chemical salt resistance, tolerance to debris and 'soiling' alongside also low pressure drop. The cooler stream is on the tube side (it flows on the tube side-internally). This is unusual and actually diminishes the heat exchange coefficient (the ability to conduct heat away); conventionally this would not be adopted. The reduction in heat exchange coefficient is, however, very modest and doesn't constitute a significant compromise. The other advantages more than make up for this, because the bigger pump and flow is on the electrolysis side, and this more than balances this negative aspect. This arrangement permits a range of coolant types to be used tube side (internally), which the shell side cannot accommodate—and consequently a significant reduction of the amount of equipment on the secondary cooling side.

The system of the invention opens the possibility of natural water ways or sea water being used as coolant in the electrolysis process. In large swimming complexes or district or industrial space heating, the heat exchanger could be tolerant to chlorinated water or inhibitors, and heat can be recovered increasing overall efficiency towards a fully passive system standard. Tests have shown >95% energy efficiency can be achieved in some instances. A key benefit of the present invention is the permissible coolant type and specification which can be any fluid roughly filtrated and provided at a temperature ranging from above freezing to 40° C. Coolant such as sea water or water from waterways cannot normally be envisaged but become possible with the invention. This trumps the narrow concern of heat exchange performance, privileging system integration and footprint. Cooling primary process water is particularly attractive in offshore applications such as but not limited to offshore wind turbine, affording significant footprint reduction and showing a pathway to future wind turbine integration. The size of the stack module(s) to be associated to the module can also be very carefully chosen to match wind turbine 'type IV' Direct Current link voltage of 690V (suitable for electrolysis). Therefore, a system of the invention may be tailored to have 300 to 350 electrochemical cells as a standard. It is important to match the DC voltage of the electron donor (wind turbine) to the load voltage (electrolyser). The present invention may define a vessel volume which is matched to the stacks it will receive.

In the present invention, the length of ducting or pipework required is reduced due to the collocation and merging of ancillaries. This results in a significant amount of parts and space saved (pipe length is the obvious one but elbows, unions, flanges, isolation valves, strainers, filters, metallic bellows, pipe hanger, anchors, lagging, heat tracing all add more head loss etc.) and will lead to a minimum pump power reduction of 1% (this is a conservative estimate as it accounts for pipe length reduction alone). Alone a pressure drop reduction of 0.6 to 1 bar over 6 bar (common in PEM electrolyser stack) and due to repositioning of the heat exchanger harnessing head of pressure generated over liquid surface in the tank will reduce pump power by 10 to 16%. An ideal situation is achieving the largest bore possible over the shortest length possible. This indicates the pathway to genuine optimised development concerning head loss and parasitic head loss. This approach is unnatural to many engineers, whose natural tendency is to add parts, not reduce them.

In a preferred embodiment, a centrifugal pump, preferably a multi-stage centrifugal pump, is used in the invention. The preferred location of the pump is shown in FIG. 1, i.e. in the pipe that outlets from the separation vessel to the electrolyser stack. A multistage centrifugal pump is preferred for the invention with its better potential for 'turndown' than single impeller pumps and offering the best synergy of power savings. 'Turndown' is normally invoked when hydrogen demand is low and primary coolant flow need is reduced. At partial or reduced hydrogen demand, less fluid needs to be pumped around the system; this is termed 'turndown'. The general idea is turning down pump speed reduces power consumption, which is highly beneficial as pump applications consume 20% of world power and green systems ought to be setting an example in energy conservation. For widely deployed electrolysis systems using very large pumps such as in the system of the invention, it is all the more relevant. It also generates appreciable operating cost saving for the client and delivers a competitive advantage.

In a preferred embodiment, the pump is one that can achieve a shaft speed that is lower for the same output flow. This is referred to as turndown ability, in other words, a pump of the invention preferably has a good turndown ability. Turndown is expected to save up to 40% of pump energy use if planned correctly.

A multi-stage centrifugal pump allows for greater turndown when using speed to control the pump, and as the Affinity Laws state, greater speed reduction results in greater reduction in kilowatt-hour used. The synergy of the pump selection with the present invention reduces head pressure, and consequently the pump number of stages can be optimized (from 6 to 3 stages; see FIG. 2) as well as benefiting from the turndown ability (37% is typical for multistage pumps versus 5% for single impeller); it is claimed this reduces power used beyond the norm achievable with multistage pump or single impeller pump alike and thus constitutes the advantage of this feature.

In the field of separation of two-phase gas-liquids, separation technology is varied. Vertical knock out towers, as referred to previously, are the simplest and most common state of the art form, but suffers from the slowest separation and the largest footprint of all. This is because it relies on residency time of the gas-water mixture (and a minimum column height is required to accommodate this) and gravity to enable water to 'drop' and gas bubbles 'to rise' towards the top of the vessel at a collection outlet.

FIG. 1 shows 3 nozzles connected to each pipe. This preferred embodiment thus divides the flow and the height by a maximum possible of 3; leading to the typical 2.6 m height choice mentioned above. This leads to more efficient separation.

In an embodiment, the present invention includes a Schoepentoeter device, which divides the mixed phase feed stream into a series of lateral and curved flowing streams. These curving streams dissipate the kinetic energy of the streams for a smooth entrance into the vessel, and also provide centrifugal acceleration to promote separation of liquid from gas.

In some embodiments, a tangential cyclone is created in the separation vessel. This relies on centrifugal acceleration to separate the gas and water. FIG. 3 shows how this may be achieved, i.e. by directing fluid flow to the side walls of the separation vessel, and at an angle.

In a preferred embodiment, the nozzles are provided tangentially or near tangentially to create centrifugal acceleration (this mechanism increases the efficiency of separation). This is shown in FIG. 3. The nozzles direct the flow against the walls of the vessel, and once it hits the bottom, it wraps or swirls around the heat exchanger following the lower curvature of the vessel, mimicking the effect of baffles disposed around a conventional cooling heat exchanger. Swirling and turbulence around the tube heat exchanger is beneficial.

There are potentially a large number of nozzles on the vessel of the invention.

However, this does not add complication as the nozzles are moulded as part of the rotational moulding vessel which is unique.

In a preferred embodiment, the present invention involves the use of demister pads consisting of fine meshes or mesh grids to further remove mist from the vapours once the separation has been affected. Additional features also include a vortex breaker and vortex spoiler.

In one embodiment the kinetic energy of the streams is disrupted by a set wire brush arrangement located coaxially to the inlet nozzles. These types of brushes are known to be cost-effective in small air gas separators.

In a preferred embodiment, the vessel walls can include foam insulation (to reduce radiated heat at off time), and a three-wall construction consisting of polypropylene, foam, and polypropylene. Lighter weight, easier handling, cleanliness, bacterial resistance and deploy-ability in large, small and specific environments alike (such as containerised package facilitated by pertinent aspect ratio or inside single storey building) is a defining utility feature; able to serve all market segments as a multiplicity of modules are interfaced by small bore pipes efficiently. The part count reduction is significant. The single vessel is designed for the most demanding of applications. The module is manufacture-able in a factory at a rate many times the rate of the current art (currently reducing 4 days down to a few hours for the equivalent vessel manufacture and avoiding lengthy burr cleaning stage (down from 2 weeks to zero). The current alkaline unit of the prior art inherits heavy industrial construction methods, part intensive design, corrosion prone systems, obsolete chemistry. For instance designs such as chloro-alkali conversions to water electrolysis are attempted successfully by many competitor companies but are outdated in that, when they were formulated as a design, little consideration was given to lean manufacturing laws when they were conceived then; this is endemic in the chemical/process industry, it is a very self-limiting and also, very often, goes unnoticed. Outdated plants are simply re-deployed and re-purposed keeping previous physical embodiment with simply the electrode chemistry or coating adapted; the rest is adjoined on a logical but ad hoc basis. The amount of fusion welding fabrication, the weights of steel structures used are simply staggering and in some instances are up to 3 storeys tall, 7 m versus 2.6 m; in line with existing practices. Their fitness for purpose is questionable and makes them appear as mere distractions when facing the task in hand of deploying hydrogen at scale in a rapidly changing world.

Oxygen air separation energetic cost is 6.6 kWh/kg. As a by-product of hydrogen generation, oxygen is not normally collected. Therefore, a net economic benefit can be achieved if it is pressurised. Steel industry decarburisation, oxyfuel or even fish farms are just a few of the applications possible. For pressure retention, in some embodiments, the vessel comprises a composite external structure covering the polymer walls obtained by rotational moulding. Therefore, in some embodiments, a metal, preferably, an aluminium skin, is rolled and riveted around the vessel of the invention. Preferably, at least 2 structural members are disposed longitudinally and vertically thus bracing and mitigating the inevitable creep of the polymer vessel under pressure.

In some embodiments, a vessel of the invention includes ports for sensor level control (e.g. 3 ports), sensor pressure control (e.g. 1 port), conductivity control (e.g. 1 port), de-ionised water circulation (e.g. inlet and outlet, 2 ports), oxygen venting (e.g. 1 port), oxygen pressure relief (e.g. 1 port), heat exchanger (e.g. in and out, 2 ports), pump outlet (e.g. 1 port), return of mixed phase ports (×3 in typical embodiment), drain (e.g. 2 ports). In total, up to 17 ports are provided constituting the saving with the prior art.

Figure 4:
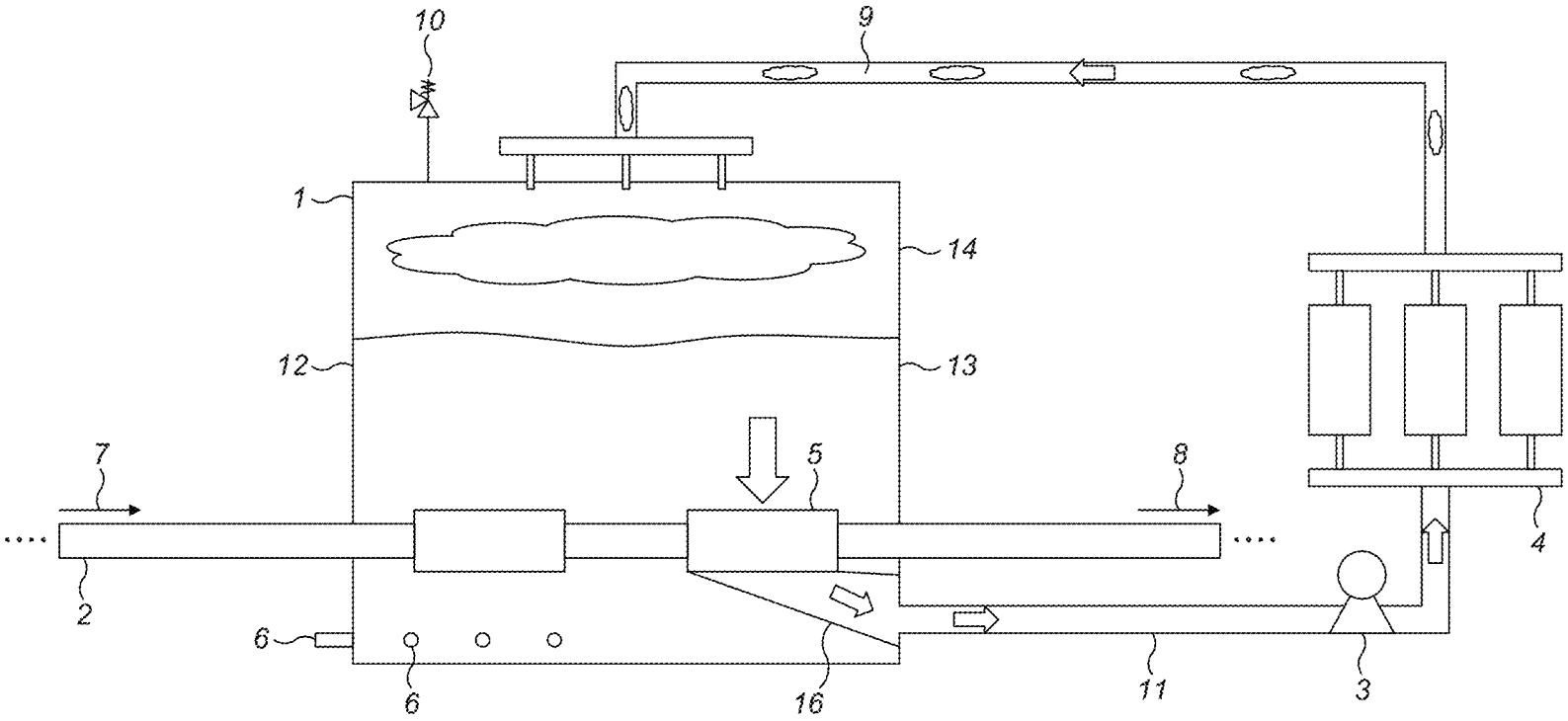
FIG. 4 is a schematic showing a preferred embodiment of the present invention.

Preferably, a vessel for use in the invention includes a tapered collector situated below the heat exchanger. It is preferably connected to the heat exchanger directly. It is preferably constructed from a polymer material. FIG. 4 illustrates the tapered collector. Item 13 is a tapered collector (preferably polymer fabrication), which fits tightly immediately underneath the heat exchanger and connects to the main pump inlet, channeling and therefore increasing the velocity of water through the heat exchanger. The pump (3) is connected to the pump outlet of the vessel and has a suction, which drags the flow vigorously through the heat exchange maximising the cooling duty.

The homogeneity of velocities of a cross flow through the heat exchanger is controlled by the taper provided which mitigates velocity close to pump outlet port and increases velocity (obtuse side) further away from the outlet (in effect reducing cross flow variation longitudinally), and is arranged to obtain a low variation of speed longitudinally through it.

Figure 8A:
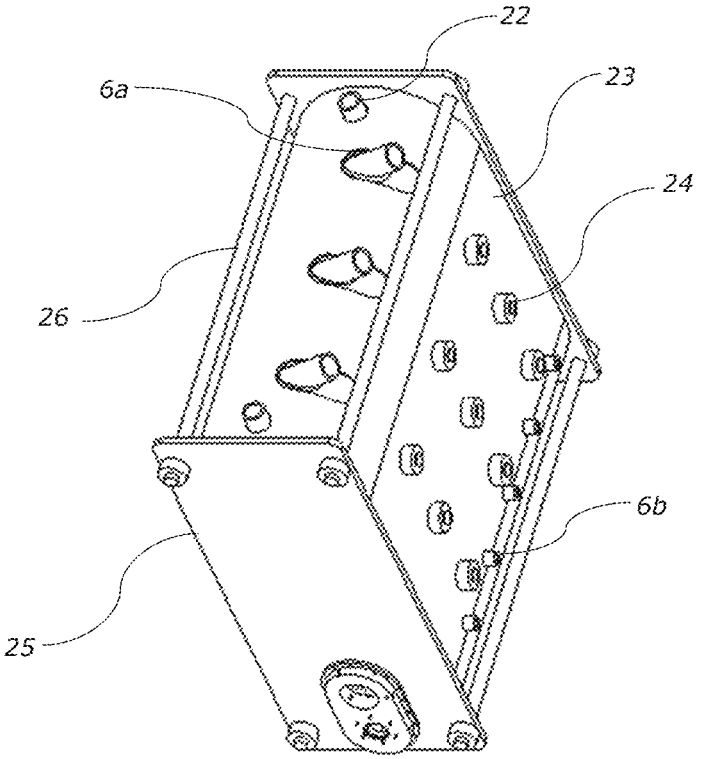
FIGS. 8*a-d* show a fourth configuration of a vessel.
Figure 8B:
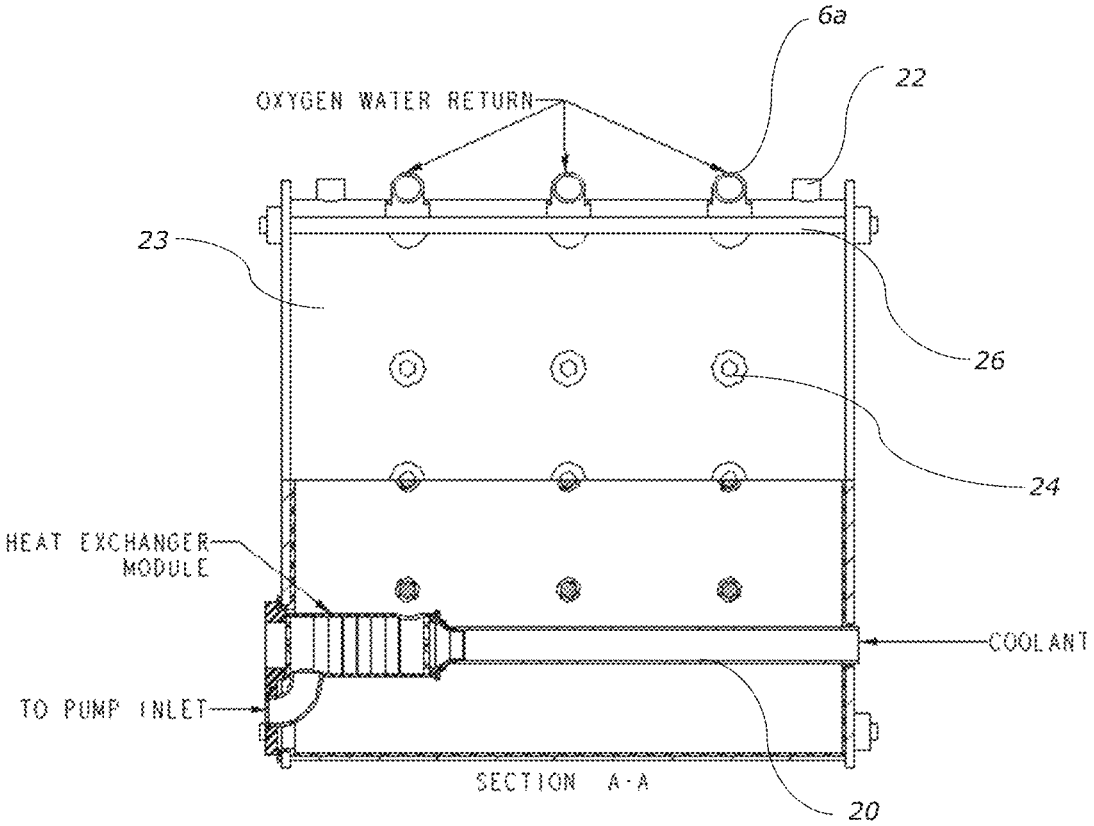
Figure 8D:
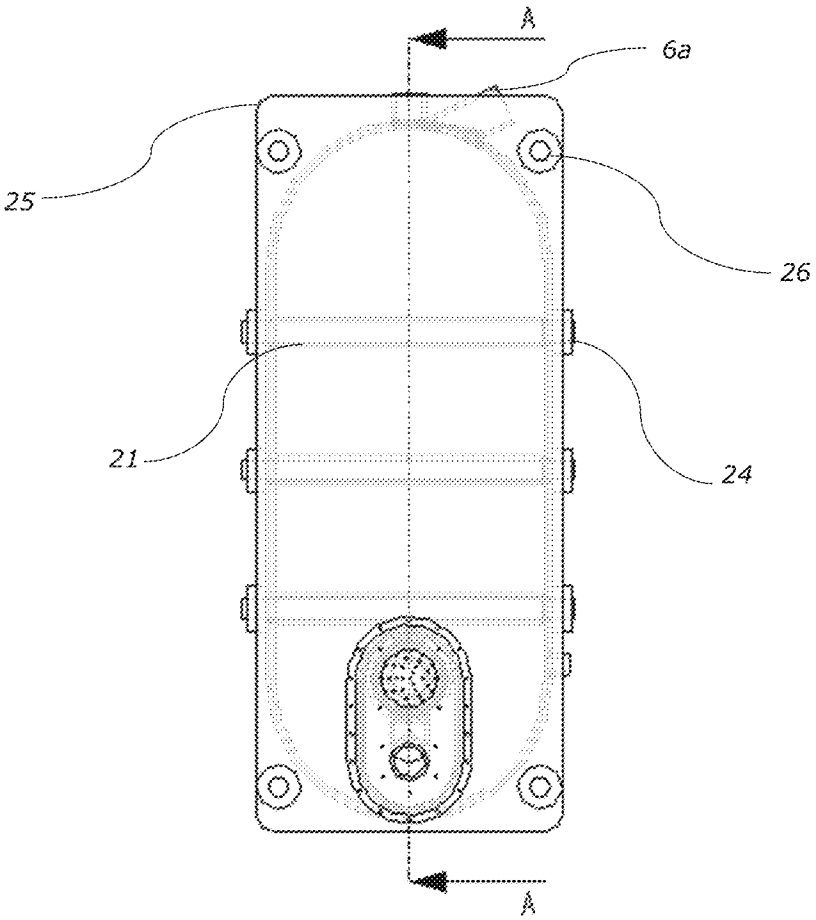
Figure 8C:
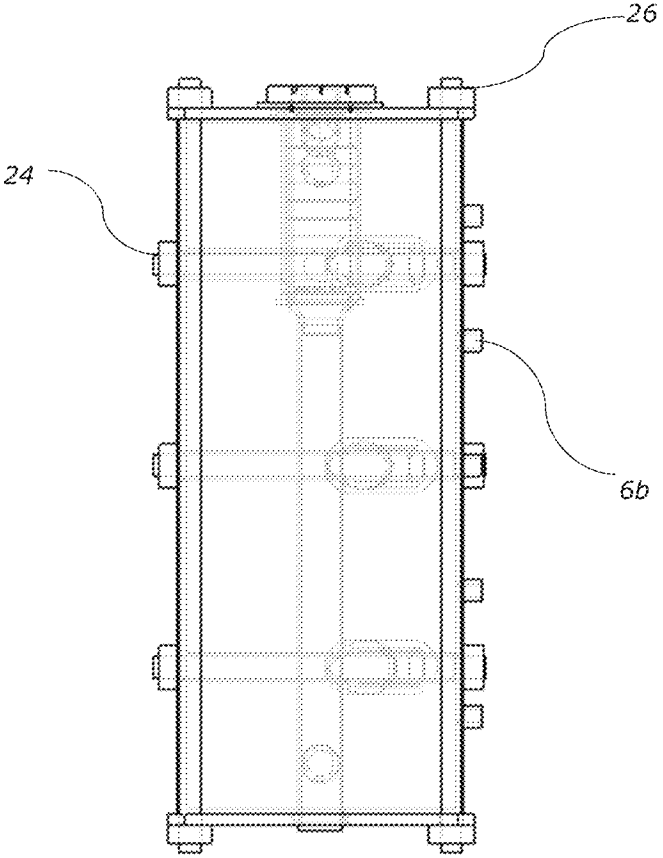

Alternatively, a vessel for use in the invention includes a sleeve situated around the heat exchanger. The said sleeve is made of polymer material. The said sleeve contains baffle plates arranged so that fluid direction is 'cross flow' around the tube maximising boundary layer disruption of tube & fluid to maximise heat exchange. The baffles, tube gaps and tube length are adapted to design heat exchanger pressure drop properties according to FIG. 8*b*.

Figure 5A:
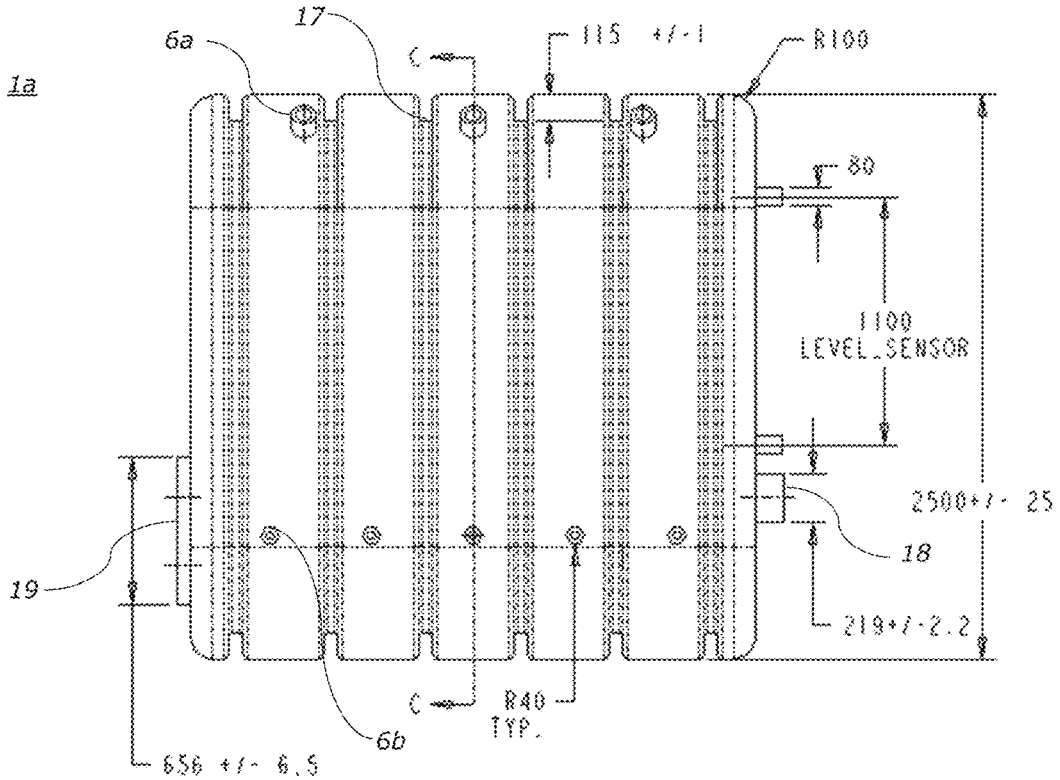
FIGS. 5*a-c* show a first configuration of a vessel.
Figure 5B:
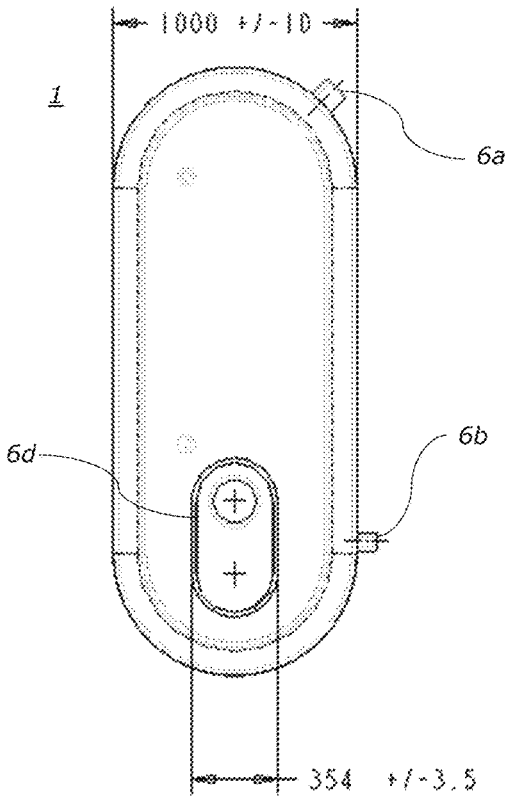
Figure 5C:
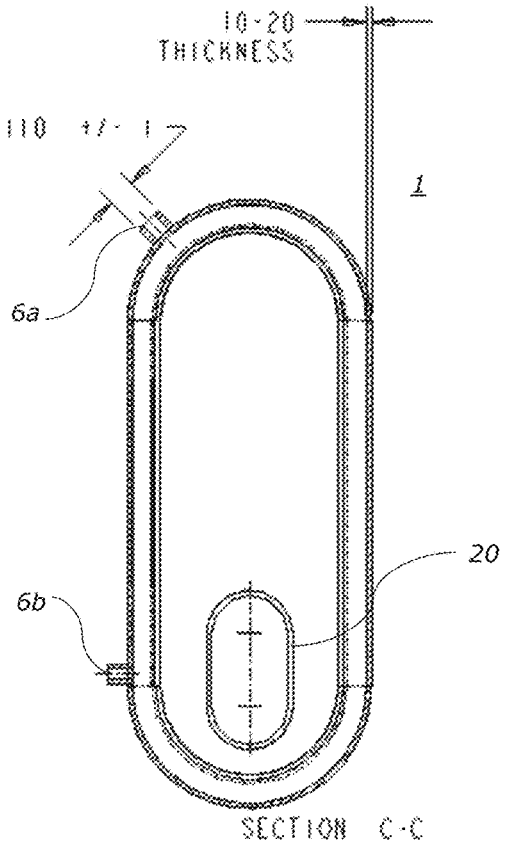

FIGS. 5*a-c* show a first configuration of an oxygen separation vessel 1*a*. FIG. 5*a* shows a side view of the vessel 1*a*, FIG. 5*b* shows an end view of the vessel 1*a*, and FIG. 5*c* shows a cross-sectional view of the vessel 1*a* through section line C-C.

The illustrated vessel 1*a* has three inlet nozzles 6*a*, five outlet nozzles 6*b*, a series of circumferential parallel grooves 17, a coolant inlet port 18 and a coolant outlet port 19.

The grooves 17 are shaped to receive bracing elements such as metal reinforcing rings. Such bracing elements provide additional strength to the vessel 1*a*, thereby mitigating the risk of the vessel 1*a* buckling due to the high pressures exerted on the interior of the vessel 1*a* during use.

As illustrated in FIGS. 5*b* and 5*c*, the inlet nozzles 6*a* are arranged at an angle (of around 45 degrees in the illustrated example), such that, in use, they direct fluid flow towards a (flat) side wall of the vessel, such that a cyclone/centrifugal effect is created (as described earlier).

As shown in FIG. 5*c*, an internal conduit 20 is formed between the coolant inlet port 18 and the coolant outlet port 19. This internal conduit allows for the flow of coolant though the vessel 1*a*, and may also have additional channels that allow for the flow of other fluids, such as water that has been separated from the water/oxygen mixture (these may be coupled to one or more outlet nozzles 6*b*). The internal conduit 20 also acts as (or houses) a heat exchanger, and it may have addition unillustrated components that enable it to function as or house such a heat exchanger (such as that in FIG. 8*b*).

Figure 6A:
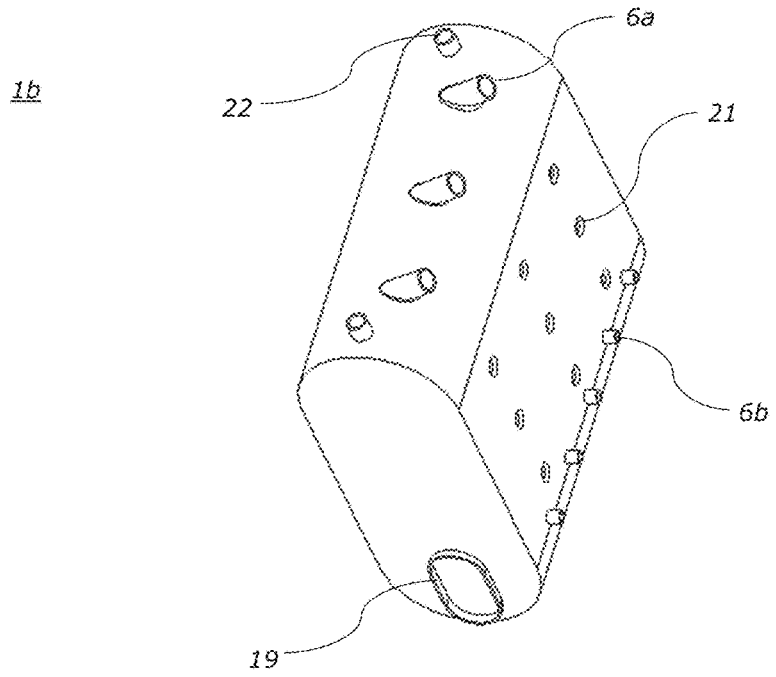
FIGS. 6*a-d* show a second configuration of a vessel.
Figure 6B:
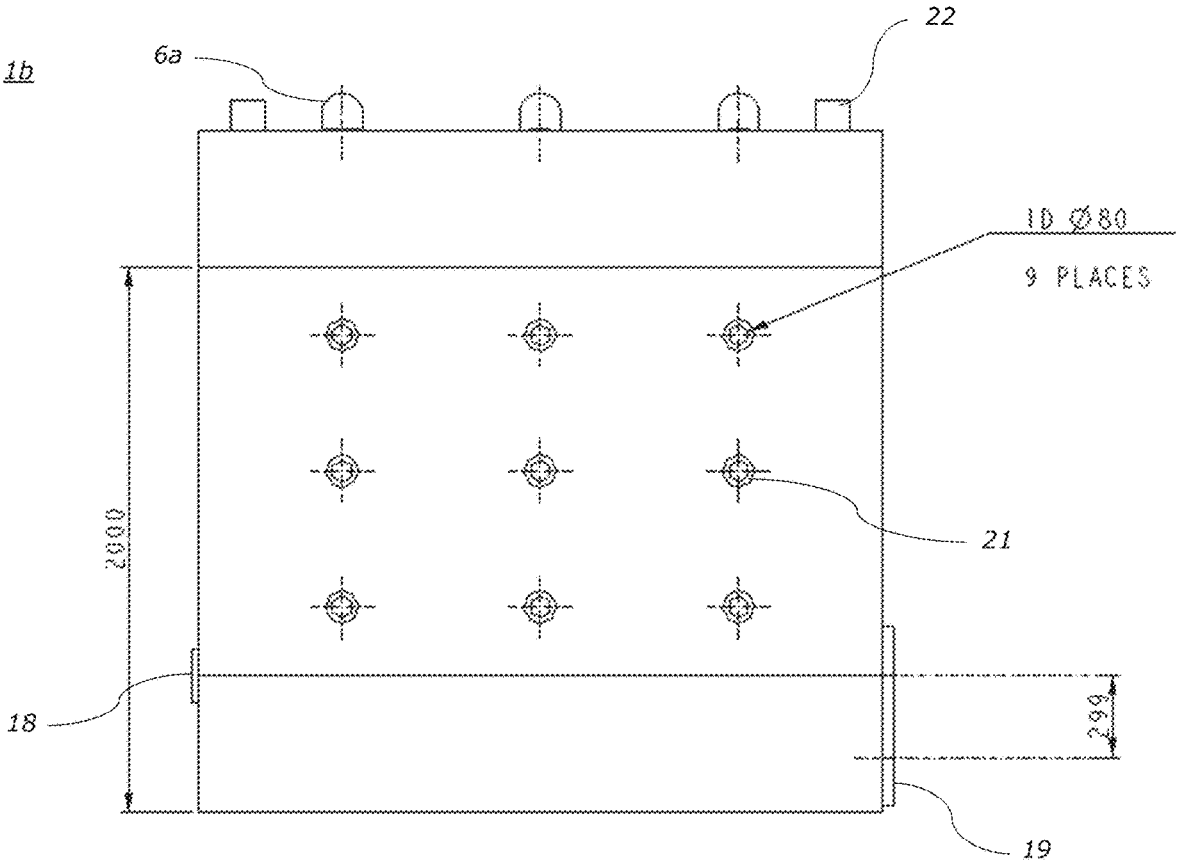
Figure 6D:
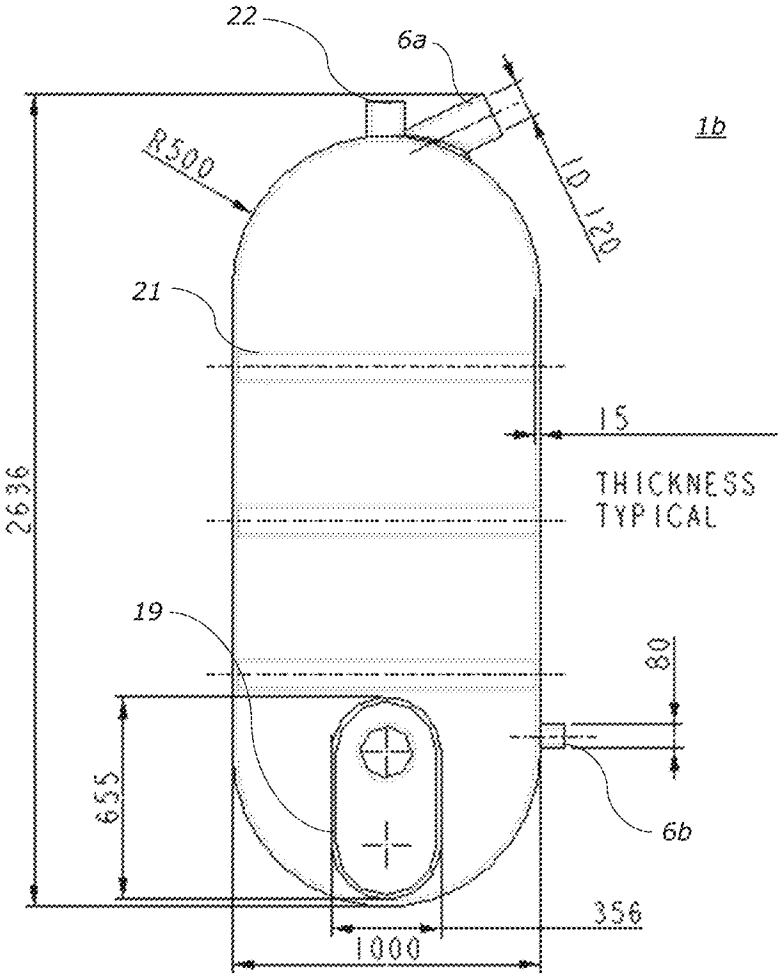
Figure 6C:
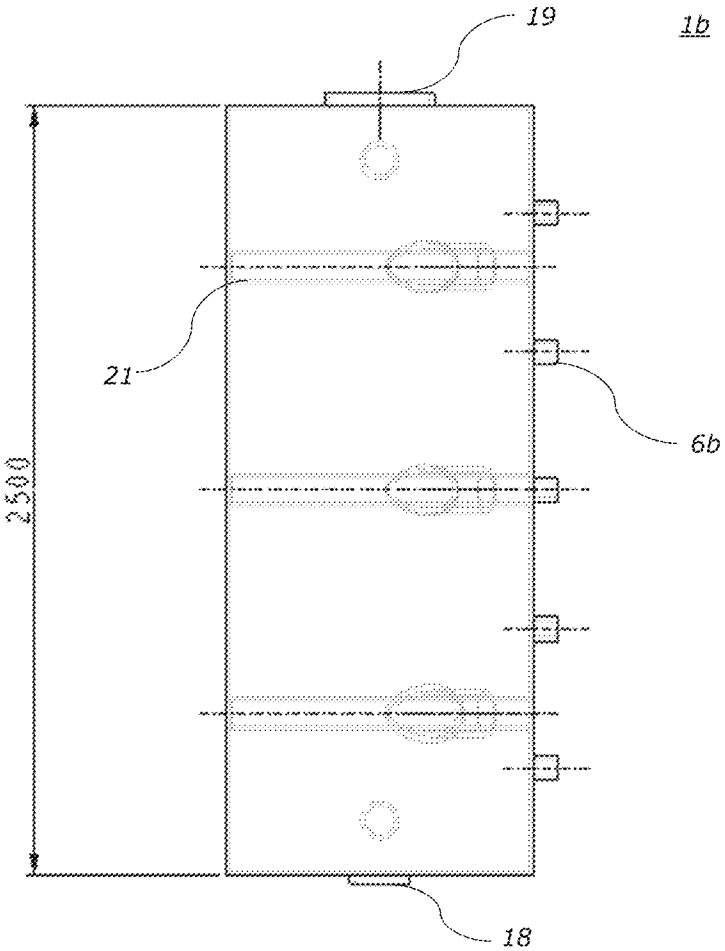
Figure 7A:
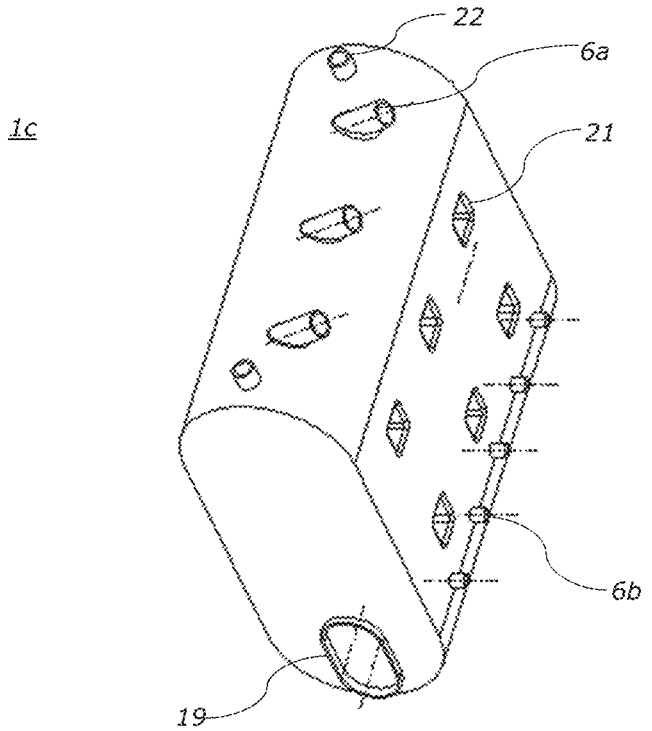
FIGS. 7*a-d* show a third configuration of a vessel.
Figure 7B:
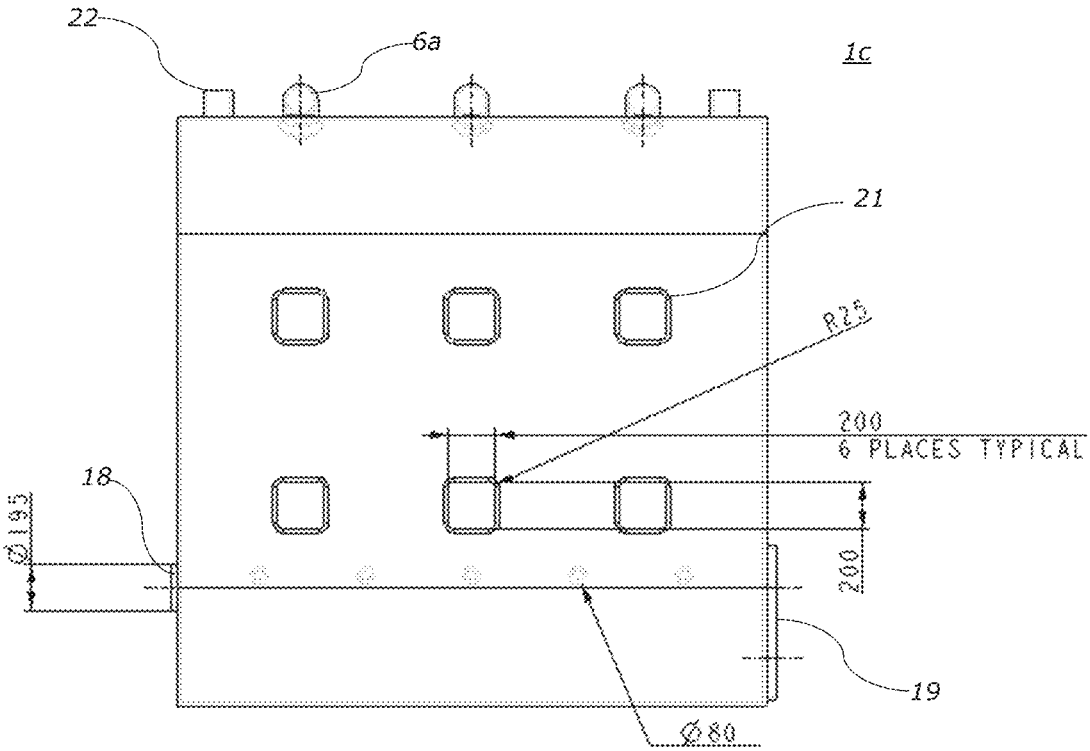
Figure 7D:
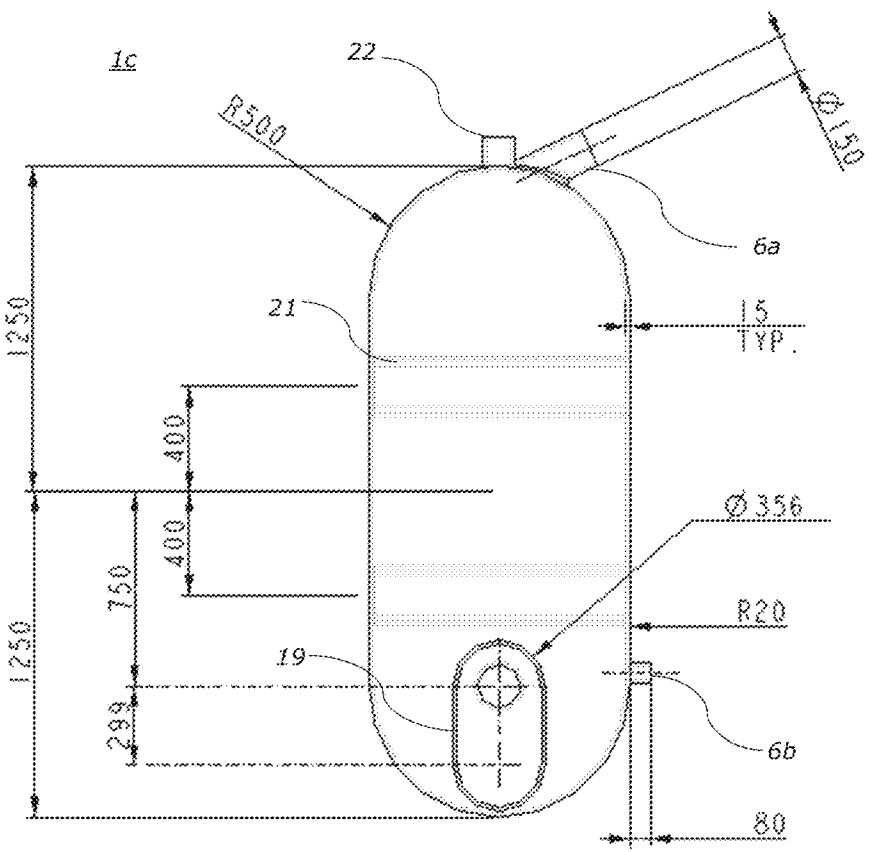
Figure 7C:
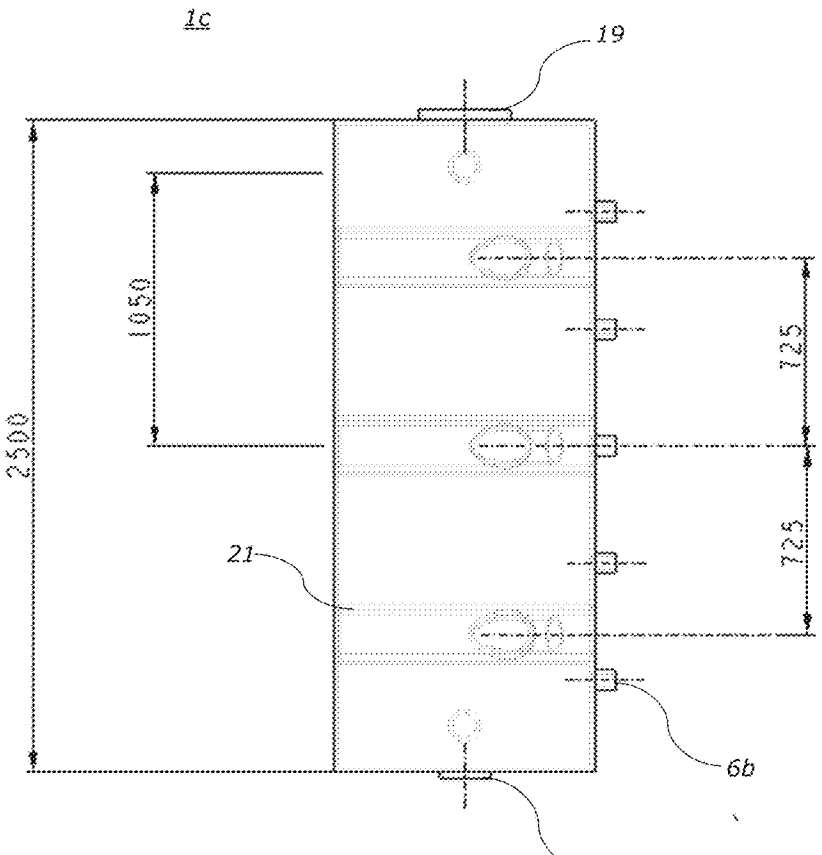

A second configuration of a vessel 1*b* is shown in FIGS. 6*a-d*. FIG. 6*a* shows a graphical projection of the vessel 1*b*, FIG. 6*b* shows a side view of the vessel 1*b*, FIG. 6*c* shows a bottom view of the vessel 1*b*, and FIG. 6*d* shows an end view of the vessel 1*b*.

The vessel 1*b* has three inlet nozzles 6*a*, five outlet nozzles 6*b*, two oxygen outlets 22 positioned at the top of the vessel 1*a*, a coolant inlet 18 and a coolant outlet 19. Unlike the vessel 1*a* in FIGS. 5*a-c*, the vessel 1*b* in FIGS. 6*a-d* does not have grooves but instead has a plurality of transversal through-holes 21 between side walls of the vessel 1*b*. The illustrated holes 21 are (substantially) circular in cross section. The example vessel 1*b* has nine holes arranged with regular spacing, but alternative numbers of holes may be used, for example four, six, eight etc.

Each hole 21 is arranged to receive a bracing element, such as a tie rod or similar that is capable of maintaining a tension force. In use, the bracing elements reinforce the vessel 1*b* against the high internal pressures, thereby preventing the vessel 1*b* from buckling or otherwise breaking/deforming. Using through-holes instead of grooves (as in FIGS. 5*a-c*) means that the side wall of the vessel 1*b* can be manufactured to be smooth whilst maintaining the strength and integrity of the vessel 1*b*. Having smooth side walls is easier to manufacture than grooved side walls, so the use of through-holes 21 additionally allows for easier and cheaper production than grooved vessels.

FIGS. 7*a-d* show another alternative vessel 1*c*. The views in FIGS. 7*a-d* correspond to those in FIGS. 6*a-d* respectively.

The vessel 1*c* is similar to that of that in FIGS. 6*a-d*, except the nine circular through-holes have been replaced with six through-holes 21 having a substantially square cross section. It should be understood that the through-holes could have other cross sections, such as (substantially) elliptical, (substantially) rectangular etc. and can be selected depending on tooling requirements during manufacture and/or the types of bracing element to be used. Similarly, there could be more or fewer through-holes. In any case, the through holes 21 are preferably arranged regularly in order to ensure an even distribution of load by transversal bracing elements.

FIGS. 8*a-d* show the vessel 1*b* of FIGS. 6*a*-6*d* provided with reinforcing elements. The views in FIGS. 8*a-d* correspond to those in FIGS. 6*a-d* respectively.

The vessel 1*b* is provided with external sheet cladding 23, which is preferably steel such as EN10028 P460 pressure steel or equivalent. The cladding 23 reinforces the vessel 1*b*, thereby helping to maintain the integrity of the vessel during use and mitigate the risk of bucking or similar.

In addition, the vessel is provided with transversal bracing elements 24 received within the through-holes 21 in the form of transversal tie rods. These bracing elements 24 are preferably made of steel, and alternative transversal bracing elements could be used in place of tie rods.

While the cladding 23 and transversal bracing elements 24 alone each provide a substantial reinforcing effect, the use of the cladding 23 and transversal bracing elements 24 in combination further enhances the reinforcing effect because it helps to spread the load exerted by the bracing elements 24 on the side walls of the vessel 1*b*, thereby increasing the load that the vessel 1*b* can withstand before breaking or buckling.

In addition to the cladding 23, the vessel 1*b* is provided with two end plates 25, each one positioned at an opposing end of the vessel 1*b*. The end plates 25 are connected by longitudinal bracing elements 26, which may again be tie rods or similar and are preferably made of steel. The longitudinal bracing elements 26 extend between the end plates 25 and are coupled at each end to one of the end plates 25. In this way, the end plates 25 in combination with the longitudinal bracing elements 26 provide reinforcement to the vessel 1*b* and prevent the vessel from buckling or breaking due to the high internal pressures experienced in use. There are preferably four longitudinal bracing elements 26, e.g. coupling each corner section of one end plate 25 to an corresponding corner section of the opposing end plate 25.

The end plates 25 are preferably made of steel, such as EN10028 P460 pressure steel or equivalent.

While the cladding 23, bracing elements 24, 26 and end plates 25 have been described in relation to the vessel 1*b* illustrated in FIGS. 6*a-d*, they could also be used with other vessels, such as that shown in FIGS. 7*a-d*. The use of transversal tie rods 24 requires that the vessel has through-holes 21, but the cladding and end plates can be used with vessels that do not have through-holes.

Alternatively, rolled aluminium or steel shell forms could be replaced by glass fibre semi cylindrical shell forms (catering for lightweight and tension stresses on circular parts of the vessel), whilst side walls (subject to bending stresses) could be made out ductile steel or aluminium.

FIG. 5*a-c*, 6*a-d*, 7*a-d*, 8*a-d* are technical drawings and show the vessel to scale, i.e. the ratios in the drawings are accurate. Any dimensions given in these figures are given in millimetres (mm). The dimensions illustrated in these figures are preferred values but should not be construed as limiting unless otherwise indicated in the claims.

It should be understood that the number of inlet nozzles 6*a* in any of the above examples could be varied. While the examples have three, there could alternatively be one, two, four or more nozzles. However, having more than one inlet nozzle is preferred, because this leads to the creation of multiple columns of the mixture within the vessel, which greatly enhances the rate of separation for a given vessel height, thereby allowing the vessel to be much shorter than conventional oxygen separation vessels.

While not all of the exemplary vessels are illustrated with an oxygen outlet 22, it should be understood that this has been omitted to simplify the drawings and that each of the vessels is intended to have at least one oxygen outlet.

Any of the vessels in FIGS. 5*a-c*, 6*a-d*, 7*a-d* and 8*a-d* could be used in combination with the system described above with reference to FIGS. 1-4.

The vessel may interchangeably be referred to as a gas separation vessel or an oxygen separation vessel. Preferred embodiments of the vessel are as an oxygen separation vessel for the separation of oxygen from a mixture containing oxygen and water (in particular in the context of green hydrogen generation from renewable electricity), but separation of other gases from other mixtures is also possible. In general, oxygen and water will be separated at different stages due to the unstable/volatile nature of oxygen/hydrogen mixtures.

The invention claimed is:

1. A system comprising an electrolyser stack and a water/gas separation vessel connected together via an inlet pipe and an outlet pipe, wherein:

the separation vessel is configured to passively separate water and gas;

the separation vessel contains a heat exchanger;

the separation vessel is constructed from a polymer material; and the separation vessel comprises at least 4 nozzles, with at least 2 nozzles configured to be in fluid communication with each of the inlet and outlet pipes, wherein the at least 4 nozzles are integral with the separation vessel and constructed from a same polymer material as the separation vessel.

2. A system according to claim 1, comprising at least 6 nozzles, wherein at least 3 nozzles are configured to be in fluid communication with each of the inlet and outlet pipes.

3. A system according to claim 1, wherein the separation vessel is rotation moulded in a single one-shot process from the polymer material.

4. A system according to claim 1, wherein the inlet and outlet pipes are constructed from a polymer material.

5. A system according to claim 1, wherein the at least 4 nozzles are connected to the inlet and outlet pipes by polymer fusion.

6. A system according to claim 1, wherein a vortex breaker, a vortex spoiler or a demister pad is located within at least one of the inlet or outlet pipes.

7. A system according to claim 1, wherein proportions of the separation vessel are such that a ratio of a height to a width of the separation vessel is less than 3:1.

8. A system according to claim 1, wherein separation vessel comprises an antibacterial or antifungal additive.

9. A system according to claim 1, wherein the heat exchanger is a tube heat exchanger.

10. A system according to claim 1, wherein the heat exchanger is configured to use water as a coolant.

11. A system according to claim 1, wherein the separation vessel includes ports for sensor level control, sensor pressure control, conductivity control, de-ionised water circulation, oxygen pressure relief and/or connection to and from the heat exchanger.

12. A system according to claim 1, wherein there is a tapered collector located between the heat exchanger and an outlet pipe from the separation vessel, such that velocity of fluid flow into the outlet pipe is increased in use.

13. A system according to claim 1, wherein the separation vessel has a flat oval cross-section, with flat side walls being positioned vertically, in use.

14. A system according to claim 13, wherein the at least 4 nozzles are positioned such that, in use, they direct fluid flow towards a flat side wall of the separation vessel, such that a cyclone effect is created.

15. A system according to claim 1, wherein at least one of the inlet and outlet pipes includes a pump for enabling fluid flow around the system, in use.

16. A system according to claim 15, wherein the pump is a centrifugal pump.

17. A method for electrolysing water using the system according to claim 1, wherein the water/gas separation vessel contains water, and wherein the electrolyser electrolyses the water to produce hydrogen and oxygen, which then flow through a pipe to the separation vessel, where one or both of the hydrogen and oxygen are passively separated from the water and extracting from the system.

* * * * *